United States Patent [19]

Guerrero

[11] Patent Number: 4,526,553

[45] Date of Patent: Jul. 2, 1985

[54] FLOPPY LIMBED WATER IMMERSIBLE FIGURE TOY

[75] Inventor: Benjamin G. Guerrero, Los Angeles, Calif.

[73] Assignee: Mattel, Inc., Hawthorne, Calif.

[21] Appl. No.: 483,464

[22] Filed: Apr. 11, 1983

[51] Int. Cl.[3] ..... A63H 3/46

[52] U.S. Cl. ..... 446/380; 446/382

[58] Field of Search ..... 46/161, 173, 163, 151, 46/22, 92, 162; 446/369, 376, 379, 382, 383, 384, 385, 390, 391, 371, 380, 156, 153

[56] References Cited

U.S. PATENT DOCUMENTS

| | | | |
|---|---|---|---|
| 2,118,682 | 5/1938 | Nagel | 446/384 |
| 2,865,134 | 12/1958 | Cohn . | |
| 3,092,930 | 6/1963 | Resinol . | |
| 3,319,376 | 5/1967 | Doppelt et al. . | |
| 3,564,762 | 2/1971 | Crosman et al. | 46/173 X |
| 3,589,061 | 6/1971 | Bear et al. . | |
| 3,816,957 | 6/1974 | Nakajima . | |
| 3,940,880 | 3/1976 | Kaelin et al. | 46/161 |

FOREIGN PATENT DOCUMENTS

| | | | |
|---|---|---|---|
| 454635 | 1/1950 | Italy | 46/161 |
| 2035103 | 6/1980 | United Kingdom | 46/161 |

*Primary Examiner*—Mickey Yu

*Attorney, Agent, or Firm*—Ronald M. Goldman; James G. O'Neil

[57] ABSTRACT

A waterproof figure toy (10) having arms (16) and legs (18) fixed to resilient connectors (20) formed on a torso (14) to provide a floppy limbed doll. The arms and legs are fixed to the connectors in any convenient manner, as by a waterproof sealant, and a head (12) is fixed to the torso (14) in a watertight manner by means of a torso neck plug (24) and a head neck plug (26) sealingly captured in the head and torso and connected together by a flexible elongated connector (28), which allows movement of the head (12) with respect to the torso (14).

5 Claims, 8 Drawing Figures

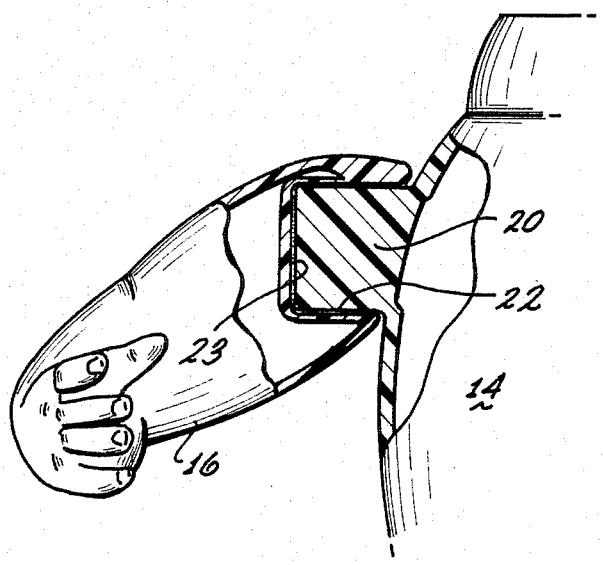
FIG. 2
FIG. 3
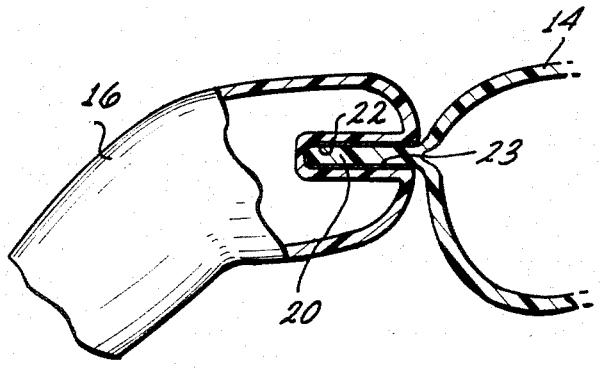

FLOPPY LIMBED WATER IMMERSIBLE FIGURE TOY

DESCRIPTION

1. Technical Field

The present invention relates generally to figure toys and more particularly to figure toys which are water immersible and which have floppy limbs.

Rag dolls have long been a favorite doll for children of all ages. The skin of such dolls, including that on the torso and legs, is usually formed of a textile material, while the inside of the doll is stuffed with pieces of fabric, cotton batting, or the like. The limbs are usually defined from the torso of the doll by lines of stitching near the torso. These lines of stitching produce what is commmonly referred to in the prior art as a "floppy-limbed doll". Such floppy limbed dolls require a great deal of manual labor to manufacture, quickly become soiled or unsightly, and are very difficult to keep clean and sanitary.

2. Background Art

Numerous ways have been suggested to produce floppy limbed dolls which overcome the above set forth disadvantages, or to manufacture such dolls without the need of manual labor. In addition, numerous patents are known which teach various joint assemblies for joining the head, arms and legs of a doll to the torso or trunk, to enable "lifelike" movement of these appendages with respect to the torso.

Examples of such prior art patents which show doll bodies or torsos having limbs fixed thereto in a manner to make them have floppy limbs, or which are made from materials which give them a "lifelike" feel are U.S. Pat. No. 2,865,134, issued Dec. 23, 1958 to Cohn. In this patent, doll arms or legs are fixed to a doll body by means of rigid bushings 16 and washers 24 inserted into an aperture 6 formed in the body, where they are held in place against the inner surface of a flange 8. U.S. Pat. No. 3,092,930, issued June 11, 1963 to Resinol, discloses a doll having a torso in which elongated slotted limb attaching openings 18, 20 are formed. Hollow limbs having flattened ends with retaining stay elements projecting from each side of the flattened limb end are inserted into the slotted limb receiving openings and engaged therein to hold the limbs in place. The retaining stay elements are held to the flattened ends of the limbs by means of a staple. U.S. Pat. No. 3,319,376 issued May 16, 1967 to Doppelt et al discloses a floppy limbed doll in which limbs are attached to a torso by hinged or narrowed sections made integrally with the torso and the limbs. The torso includes a foamed filled neck having a mushroom configuration to which the head is attached by an overhanging flange portion. Because the shank portion of the neck is narrow and resilient, the head moves or swings with respect to the torso.

In addition, U.S. Pat. No. 3,589,061, issued June 29, 1971 to Bear et al and assigned to Mattel, Inc. the assignee of the present invention, shows elongated armature means for connecting the various appendages to the torso of the doll. The armature means are made from a resilient material to allow the appendages to be moved from rest positions, to which they will be returned, by the biasing action of the resilient material.

Finally, U.S. Pat. No. 3,816,957, issued June 18, 1974 to Nakajima, discloses a doll having relatively soft, hollow parts, in which the parts are connected together by means to prevent water from invading the interior of the hollow parts.

None of the above identified patents describe a floppy limbed doll which may be immersed in water for cleaning and/or for play by a child. Nor do they disclose dolls which have the specific watertight joints of the type disclosed in the present invention.

DISCLOSURE OF THE INVENTION

In accordance with the present invention, a figure toy having a head and a torso of the type which is immersible in water without water finding its way internally of the torso is disclosed. The figure toy includes unitary exterior limb connectors formed integrally with the torso during a molding operation using a water impervious, elastic, polymeric material. Limbs having upper-ends shaped to simulate the external appearance of the portion of the limbs which are normally used to attach the limbs to the figure toy and cavities provided in the upper-end of the limbs. The cavities are shaped and sized to receive the limb connectors with a relatively close fit. The cavities have open proximate ends, an encompassing side wall, and a closed distal end. The mass of the limbs is great compared to the size of the limb connectors. In this manner, the limbs and the connectors coact together in the manner of a "floppy limb" on the figure toy. Means are provided to connect the limbs to the connectors and the torso includes a neck opening at its upper-end, while the head includes a neck opening at its lower end. The head and torso are connected together by plugs with an elongated connector holding the plugs together in a manner such that water is prevented from entering the head and torso through the connector and plugs.

Further objects, features and advantages of the invention will become apparent upon a reading of the specification when taken in conjunction with the drawings in which like reference numerals refer to like elements throughout the several views.

BRIEF DESCRIPTION OF THE DRAWINGS

FIG. 2 is an enlarged partial front view showing a partial sectional view of an arm connected to a connector;

FIG. 3 is an enlarged partial top plan view showing a partial cross-section of the limb of FIG. 2 connected to the connector;

BEST MODE FOR CARRYING OUT THE INVENTION

Figure 1:
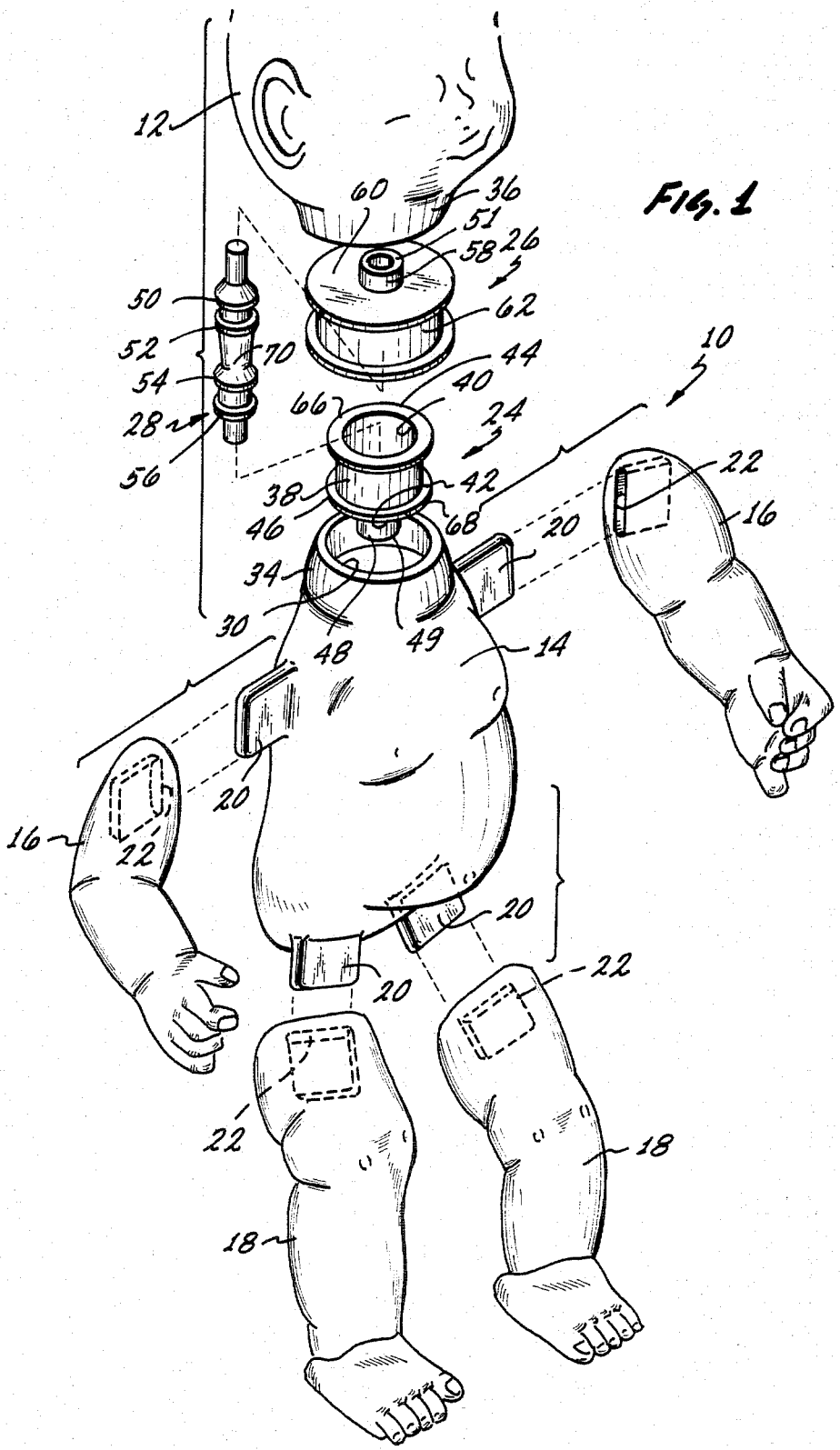
FIG. 1 is an exploded perspective view of a figure toy of the present invention.

Referring now to the drawings and particularly FIG. 1, there shown is a figure toy 10, which can take any desired shape, but which is preferably in the shape of a baby doll having a hollow head 12, a hollow torso 14 and a number of entirely closed hollow limbs, such as arms 16 and legs 18. All of the elements of the doll are made from the same material having a soft, resilient skin like feel. One such material is plastisol, a water-impervious, elastic, polymeric material which may be easily molded.

The torso 14 has integrally formed therewith a plurality of exterior flexible tabs or unitary extending connectors 20 by which the limbs may be attached to the torso to form flexible or floppy limbs. Each of the extending limb connectors 20 is substantially rectangular in shape with two major surfaces, essentially parallel to each other, extending outwardly from the torso, and a plurality of minor surfaces, connecting the major surfaces. As is shown in FIGS. 1–3, the major surfaces are distinctly greater in area than the minor surfaces, to thereby allow the limb connectors 20 to flex or move, mainly in a direction perpendicular to the major sufaces.

Each of the limbs 16 and 18 are entirely enclosed, and provided with internally extending cavities 22, shaped and sized to receive a limb connector therein in a relatively close fit. A waterproof adhesive, cement or glue 23 is used to seal the limbs to the respective connectors. Each cavity has an open proximate end, an encompassing sidewall and a closed distal end. The mass of each of the limbs is much greater than that of the corresponding flexible connector to which it is connected. Therefore, each of the flexible connectors allows the limb thereon to move or flex in the manner of a floppy limb.

Figure 4:
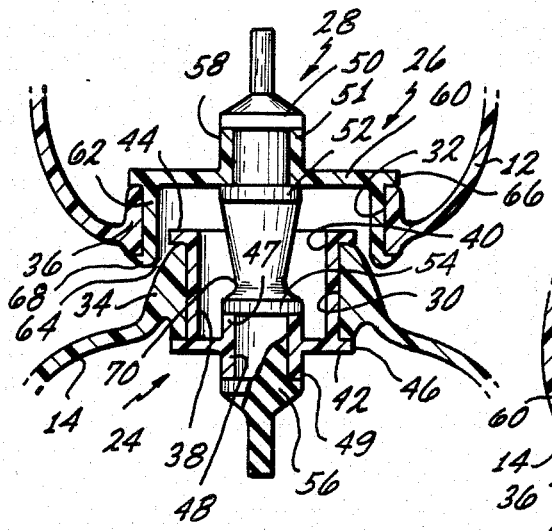
FIG. 4 is a partial sectional view showing the head neck plug, the torso neck plug and the elongated connector fixed therebetween.
Figure 5:
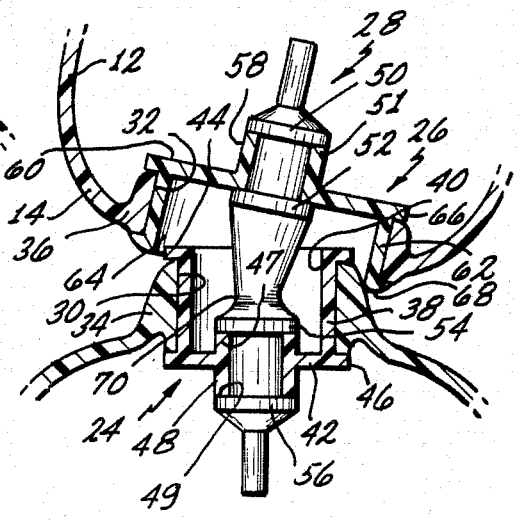
FIG. 5 is a view similar to that shown in FIG. 4 with a toy figure head canted to one side.
Figure 6:
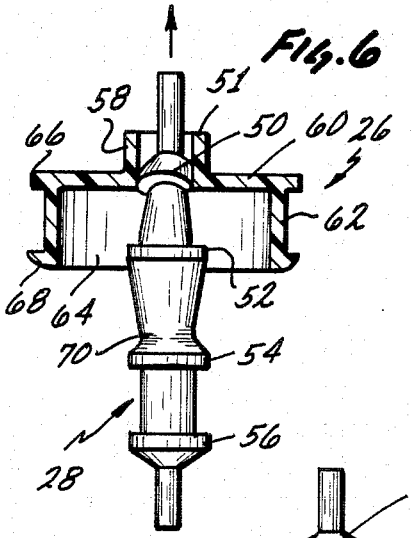
FIG. 6 shows the head neck plug with the elongated connector being inserted therein.
Figure 7:
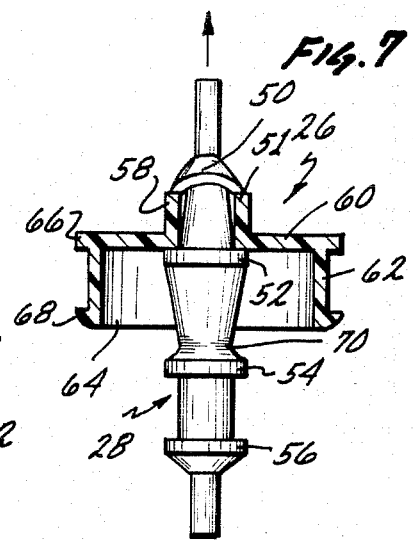
FIG. 7 is a view similar to that of FIG. 6 with the upper lip of the elongated connector almost entirely through the opening in the neck plug.
Figure 8:
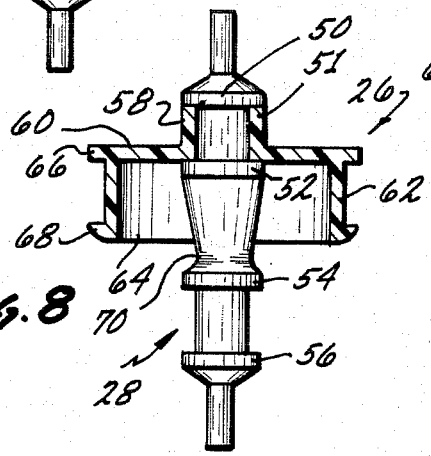
FIG. 8 shows the elongated connector entirely inserted into the head neck plug with its upper and lower lips firmly holding the cylindrical boss of the head neck plug therebetween.

The hollow torso 14 is provided with a neck opening 30 which is made watertight by sealing means, such as a torso neck plug 24. Torso neck plug 24 is resiliently connected to a head neck plug 26 by a flexible elongated connector 28. These neck plugs and the elongated connector 28 may be made from any suitable flexible material such as an injection molded plastic. The torso neck plug 24 is inserted in and fixedly held in a watertight manner in the neck opening 30 at the upper end of the torso, while the head neck plug is inserted in and fixedly held in a watertight manner in neck opening 32 of head 12. Each of the neck openings 30, 32 is provided with an annular flange 34, 36 having upper and lower edges, as viewed in FIGS. 4 and 5.

The torso neck plug 24 is preferably circular in cross section and includes an encompassing sidewall 38, an open top 40 and a closed bottom wall 42. A first annualar lip portion 44 is formed encompassing the opened top, with a second annular lip portion 46 formed integrally with the closed bottom wall and encompassing the same. In addition, a hollow cylindrical boss 48 is provided centrally in the bottom wall 42 with an upper edge 47 and a lower edge 49.

The elongated connector 28 is inserted into the head and torso neck plugs to resiliently and movably hold the head to the torso. The elongated connector includes a plurality of spaced apart shoulders and reduced diameter portions formed integrally therewith to enable the connector to be inserted into and held betweeen the head neck plug and the torso neck plug either before or after the respective neck plugs have been inserted in and held within the head and torso of the figure toy. This is more clearly shown in FIGS. 4, 6, 7, and 8. By way of example, the upper end of elongated connector 28 is resilient and may first be inserted into a second hollow cylindrical boss 58 formed centrally in an upper wall 60 of head neck plug 26. When entirely inserted through and held in position, a first resilient shoulder 50 rests against an upper edge 51 of the boss 58, while a second or lower resilient shoulder 52 is pressed against a lower edge of the boss, formed flush with the lower wall 60, to firmly hold the elongated connector therein in a watertight manner.

The head neck plug 26 includes an encompassing sidewall 62, an open bottom 64 and top wall 60, with boss 58 extending upwardly therefrom. Top wall 60 includes a resilient annular lip 66 encompassing the top wall, while a further resilient annular lip 68 encompasses the open bottom 64. The head neck plug 26 is inserted in the head 12 and captured therein by the action of the encompassing annular lips 66 and 68 resiliently pressing against the upper and lower surfaces of the annular flange 36. This coaction provides a watertight seal between the head neck plug 26 and the annular flange 36 of head 12. The torso neck plug 24 is inserted in the torso neck opening 30 and held therein by means of the encompassing annular lips 42, 44 coacting with the upper and lower surfaces of the annular flange 34 in a watertight manner. The other or lower end of the elongated connector 28 is inserted into the opening in boss 48 and is held therein in a watertight manner between a third shoulder 54 and a fourth shoulder 56, resiliently pressing against the upper edge 47 and lower edge 49 of the annular boss 48.

The head 12 may flex and/or tilt with respect to the torso 14, in any desired direction, by means of a reduced diameter section 70 formed on the elongated connector adjacent the third shoulder 54. Since the elongated connector is made from a resilient, flexible plastic material, such as vinyl, pressing against the head of the figure toy allows the head to be moved or rocked from its rest position, about the elongated connector by the flexing of the elongated connector at the reduced diameter portion 70 (see FIG. 5). The head will be returned to the up-right or rest position by the biasing action of the resilient material of the elongated connector.

It therefore can be seen that a watertight, water immersible figure toy has been provided. The toy includes lifelike floppy arms and legs which move about flexible connectors, but which are attached thereto in such a manner as to prevent water from entering the interior of the limbs or the torso of the figure toy. Therefore, a figure toy such as a baby doll may be used by a child within a bath tub or the like, without damaging the doll.

The limbs of the doll may be moved by the child to simulate real life movement of a baby's limbs, and to splash or wiggle in water. In addition, the head of the doll, also fixed to the torso in a watertight manner, may be moved by the child in any desired direction, and always return to its upright or rest position.

While there has been shown and described a preferred embodiment of the invention, it is to be understood that there are numerous other adaptations or modifications that may be made within the spirit and scope of the attached claims.

I claim:

1. In combination with a figure toy having a head, a torso, and a plurality of limbs, said figure toy being of the type which is immersible in water without water finding its way internally of said torso, said head, and said limbs, the improvement which comprises:

a plurality of unitary exterior limb connectors formed integrally with said torso during a molding operation using a water-impervious, elastic, polymeric material;

a plurality of limbs, each of said limbs being shaped to simulate the external appearance of a limb which is normally attached to the respective portion of said torso;

a cavity provided in each of said limbs, each of said cavities being shaped and sized to receive a respective limb connector with a relatively close fit, each of said cavities being formed integrally within said respective limb and having an open proximate end, an encompassing side wall and a closed distal end, the mass of each of said limbs being great compared to the size of said respective limb connector, whereby a limb and the connector to which it is attached will coact in the manner of a floppy limb on said figure toy;

means connecting each of said limbs to its respective connector;

said torso includes a neck opening at the upper end thereof, and wherein said head includes a neck opening at the lower end thereof, each of said neck openings including an annular flange having an upper edge and a lower edge, and wherein said figure toy includes:

a torso neck plug having an encompassing side wall, an open top and a closed bottom wall;

a first annular lip encompassing said open top on said torso neck plug;

a second annular lip encompassing said open top on said torso neck plug;

a first hollow, cylindrical boss provided in said bottom wall portion of said torso neck plug, said first boss having an upper edge and a lower edge;

a head neckplug having an encompassing side wall, an open bottom and a closed top wall;

a third annular lip encompassing said open bottom on said head neck plug;

a fourth annular lip encompassing said top wall on said head neck plug;

a second hollow, cylindrical boss provided in said top wall portion of said head neck plug, said second boss having an upper edge and a lower edge, said lower edge of said second boss being flush with said top wall portion of said head neck plug; and an elongated connector for connecting said head neck plug to said torso neck plug in a manner such that water is prevented from entering said head through said second boss and said torso through said first boss, said first and second annular lips engaging said annular flange on said torso and said third and fourth annular lips engaging said annular flange on said head with a sufficiently tight fit that water will not enter said torso and said head between said neck plug and said annular flanges.

2. A combination as recited in claim 1 wherein each of said limb connectors has major and minor surfaces, said major surfaces are essentially parallel and distinctly greater in area than the area of said minor surfaces.

3. A combination as recited in claim 1, wherein said figure toy is a doll, wherein each of said limbs is an arm, and wherein each arm includes an upper end which comprises the shoulder portion of said arm.

4. A combination as recited in claim 1 wherein each of said limbs is a leg.

5. A combination as recited in claim 1 wherein there are four limb connectors, two of which have limbs in the shape of an arm connected thereto by means of a waterproof sealant, and the other two of which have limbs in the shape of a leg connected thereto by means of a waterproof sealant.

* * * * *